US007593683B2

(12) United States Patent
Kim et al.

(10) Patent No.: US 7,593,683 B2
(45) Date of Patent: Sep. 22, 2009

(54) PAPER ARRANGING DEVICE, AND ELECTROPHOTOGRAPHIC IMAGE FORMING APPARATUS WITH THE SAME

(75) Inventors: Woo-seog Kim, Seongnam-si (KR); Nao-wan Kang, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 11/154,714

(22) Filed: Jun. 17, 2005

(65) Prior Publication Data

US 2006/0078362 A1 Apr. 13, 2006

(30) Foreign Application Priority Data

Oct. 12, 2004 (KR) ..... 10-2004-0081356
Dec. 15, 2004 (KR) ..... 10-2004-0106546

(51) Int. Cl.
*G03G 15/00* (2006.01)

(52) U.S. Cl. ..... 399/388; 271/258.01; 271/265.01; 271/272

(58) Field of Classification Search ..... 399/388; 271/258.01, 265.01
See application file for complete search history.

(56) References Cited

U.S. PATENT DOCUMENTS 5,290,021 A * 3/1994 Murooka et al. ..... 271/9.09
7,183,589 B2 * 2/2007 Kameyama et al. ..... 257/100
2003/0118385 A1 * 6/2003 Isemura et al. ..... 399/388
2003/0215274 A1 * 11/2003 Ahn ..... 399/388
2004/0104525 A1 * 6/2004 Suzuki et al. ..... 270/32

FOREIGN PATENT DOCUMENTS

JP 64-8158 1/1989

(Continued)

OTHER PUBLICATIONS

Chinese Office Action dated Feb. 15, 2008 issued in CN 2005-10108817.1.

(Continued)

*Primary Examiner*—Judy Nguyen
*Assistant Examiner*—Andy L Pham
(74) *Attorney, Agent, or Firm*—Stanzione & Kim LLP

(57) ABSTRACT

A paper arranging device includes a driving roller and an idle roller disposed adjacent to each other to form a nip, a first sensor to sense a location of moving paper, and a lever having a first end which extends to a perimeter of the nip to block a tip of the paper moving toward the nip and the other end which extends to a perimeter of the sensor, the lever being rotatable with respect to a predetermined pivot axis between the first end and the second end of the lever. When the first end of the lever is pressed by the tip of the moving paper and reaches a first position, the first sensor determines that the tip of the paper is entering the nip and generates a first sensing signal. When the first end of the lever is pressed by the tip of the moving paper and reaches a second position at which the paper has proceeded farther than at the first position, the first sensor determines that the tip of the paper passes through the nip and generates a second sensing signal.

36 Claims, 11 Drawing Sheets

FOREIGN PATENT DOCUMENTS

| | | |
|---|---|---|
| JP | 01-188377 | 7/1989 |
| JP | 04-164733 | 6/1992 |
| JP | 07-157147 | 6/1995 |
| JP | 08-151145 | 6/1996 |
| JP | 2000-43352 | 2/2000 |
| JP | 2000-72281 | 3/2000 |
| JP | 2002-302299 | 10/2002 |
| KR | 2000-4846 | 3/2000 |
| KR | 2003-47560 A | 6/2003 |
| KR | 2003-88722 A | 11/2003 |

OTHER PUBLICATIONS

Chinese Office Action dated Mar. 13, 2009 issued in CN 2005101088171.

* cited by examiner

PAPER ARRANGING DEVICE, AND ELECTROPHOTOGRAPHIC IMAGE FORMING APPARATUS WITH THE SAME

CROSS-REFERENCE TO RELATED APPLICATIONS

This application claims the priority under 35 U.S.C. § 119 from Korean Patent Application No. 10-2004-81356, filed on Oct. 12, 2004, and Korean Patent Application No. 10-2004-106546, filed on Dec. 15, 2004, in the Korean Intellectual Property Office, the disclosures of which are incorporated herein in their entirety by reference.

BACKGROUND OF THE INVENTION

1. Field of the Invention

The present general inventive concept relates to a paper arranging device, and more particularly, to an electrophotographic image forming apparatus with the same.

2. Description of the Related Art

In general, an electrophotographic image forming apparatus prints a desired image by developing a latent image formed on a circumference of a photosensitive medium through optical scanning into a visible image by supplying toner onto the latent image, transferring the visible image onto paper, and fusing the visible image with the paper. The visible image is transferred onto and fused with the paper as the paper is transferred along a predetermined path. A paper arranging device arranges the paper to be moved toward the photosensitive medium so as to transfer the visible image onto a desired part of the paper. The paper arranging device is installed before the photosensitive medium in the predetermined path along which the paper is transferred.

FIGS. 1 and 2 are diagrams illustrating the operation of a conventional paper arranging device 10 to be installed in a conventional electrophotographic image forming apparatus. Referring to FIGS. 1 and 2, the paper arranging device 10 includes a driving roller 12, an idle roller 14, a photosensor 16, and a lever 18. The driving roller 12 and the idle roller 14 face each other, thus forming a nip N. The lever 18 is pressed and rotated by a tip Pa of moving paper P. The driving roller 12 is rotated by power generated by a motor (not shown), and the driving roller 12 is selectively connected to or disconnected from the motor through an electronic clutch (not shown).

Until the tip Pa of the paper P moving upward (see the arrows of FIGS. 1 and 2) arrives at the lever 18, the electronic clutch does not connect the driving roller 12 to the motor, thereby preventing the driving roller 12 and the idle roller 14 from being rotated. When the tip Pa of the paper P presses a first end 18*a* of the lever 18 upward, the lever 18 is rotated to turn a second end 18*b* of the lever 18 downward. Then, referring to FIG. 2, the second end 18*b* is separated from the photosensor 16, and the photosensor 16 senses the paper P. Next, the tip Pa of the paper P is curled by the nip N to arrange the paper P. The electronic clutch connects the driving roller 12 to the motor a predetermined time after the photosensor 16 senses the paper P, and the driving roller 12 and the idle roller 14 are rotated to transfer the paper P. A light scanning device (not shown) and a photosensitive medium (not shown) operate sequentially after a predetermined time after the electronic clutch operates so as to transfer an image onto a desired part of the paper P.

The conventional paper arranging device 10 sets times, i.e., an exposure time, when the light scanning device and the photosensitive medium begin to operate according to a time when the electronic clutch begins to operate. Thus, a delay in the operation of the electronic clutch increases an error between a substantial position and desired position of an image on the paper P.

FIGS. 3 through 5 are diagrams illustrating the operation of another conventional paper arranging device 50 to be installed in a conventional electrophotographic image forming apparatus. Referring to FIGS. 3 through 5, the paper arranging device 50 includes a driving roller 52, an idle roller 54, lower and upper levers 58 and 64, and lower and upper photosensors 56 and 62. The driving roller 52 and the idle roller 54 face each other, thus forming a nip N, and are installed between the lower and upper levers 58 and 64 and also between the lower and upper photosensors 56 and 62. The driving roller 52 is rotated by power generated by a motor (not shown), and selectively connected to or disconnected from the motor through an electronic clutch (not shown).

Until a tip Pa of paper P moving upward (see the arrows of FIGS. 3-5) arrives at the lower lever 58, the electronic clutch does not connect the driving roller 52 to the motor, thereby preventing the driving roller 52 and the idle roller 54 from being rotated. When the tip Pa of the paper P presses a first end 58*a* of the lower lever 58 upward, the lower lever 58 is rotated to turn a second end 58*b* of the lower lever 58 downward. Then, referring to FIG. 4, the second end 58*b* of the lower lever 58 is separated from the lower photosensor 56, and the lower photosensor 56 senses the paper P. Next, the tip Pa of the paper P is stopped and curled by the nip N, and thus, the paper P is arranged. The electronic clutch connects the driving roller 52 and the motor a predetermined time after the lower photosensor 56 senses the paper P, and the driving roller 52 and the idle roller 54 are rotated to transfer the paper P.

When the tip Pa of the paper P passes through the nip N and presses a first end 64*a* of the upper lever 64 upward, the upper lever 64 is rotated to turn a second end 64*b* of the upper lever 64 downward. Then, referring to FIG. 5, the second end 64*b* of the upper lever 64 is separated from the upper photosensor 62, and the upper photosensor 62 senses that the tip Pa of the conventional paper P has passed through the paper arranging device 50. A light scanning device (not shown) and photosensitive medium (not shown) begin to operate a predetermined time after the upper photosensor 62 senses the paper P, and transfer an image onto a desired part of the paper P.

The conventional paper arranging device 50 of FIGS. 3-5 sets times, i.e., an exposure time, when the light scanning device (not shown) and a photosensitive medium (not shown) begin to operate according to a time when the upper photosensor 62 senses the paper P. Therefore, unlike the paper arranging device 10 of FIGS. 1-2, an irregular delay in the operation of the electronic clutch does not remarkably increase an error between a substantial position and a desired position of the image on the paper P. However, as compared to the conventional paper arranging device 10 of FIGS. 1-2, the conventional paper arranging device 50 of FIGS. 3-5 requires an additional photosensor and an additional lever, thereby increasing manufacturing costs.

SUMMARY OF THE INVENTION

The present general inventive concept provides a paper arranging device with a sensor and a lever, which is capable of minimizing an error between a substantial position and a desired position of an image on paper, and an electrophotographic image forming apparatus with the same.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a paper arranging device usable with an electrophotographic image forming apparatus, the paper arranging device comprising a driving roller and an idle roller disposed adjacent to each other to form a nip, a first sensor to sense a location of moving paper, and a lever having a first end which extends to a perimeter of the nip to block a tip of the paper moving toward the nip and a second end which extends to a perimeter of the sensor, the lever being rotatable with respect to a predetermined pivot axis between the first end and the second end of the lever. When the first end of the lever is pressed by the tip of the moving paper and reaches a first position, the first sensor determines that the tip of the paper is entering the nip and generates a first sensing signal. When the first end of the lever is pressed by the tip of the moving paper and reaches a second position at which the paper has proceeded farther than at the first position, the first sensor determines that the tip of the paper has passed through the nip and generates a second sensing signal.

A time when the driving roller is rotated may be determined based on the first sensing signal output from the first sensor.

A time when a photosensitive medium of the electrophotographic image forming apparatus on which a latent image is formed is exposed to light, may be determined based on the second sensing signal output from the first sensor.

The paper arranging device may further include a stopper to regulate a rotation angle of the lever.

The lever may be elastically biased, such that the first end of the lever can return to an initial position thereof where the first end of the lever blocks the tip of the paper moving toward the nip.

The first sensor may be a photosensor.

The paper arranging device may further include a second sensor which is spaced apart from the first sensor and senses the location of the moving paper. When the first end of the lever is pressed by the tip of the paper and reaches a third position deviating from a path of the paper, the second sensor may determine that the paper is passing through the nip and may generate a third sensing signal. When the first end of the lever returns to the initial position from the third position, the second sensor may determine that an end of the paper has passed through the nip and may generate a fourth sensing signal.

The second sensor may be a photosensor.

The foregoing and/or other aspects and advantages of the present general inventive concept may be achieved by providing an electrophotographic image forming apparatus comprising a light scanning device to scan light corresponding to an image signal, a photosensitive medium on which a latent image is formed when the photosensitive medium is exposed to the light, a paper arranging device, and a controller to control times when a driving roller of the paper arranging device is rotated and when the photosensitive medium is exposed to the light based on a first sensing signal and a second sensing signal output from a first sensor of the paper arranging device. The paper arranging device includes the driving roller and an idle roller which are positioned before the photosensitive medium along a path of paper, the driving roller and the idle roller disposed adjacent to each other, to form a nip, the first sensor to sense a location of the moving paper, and a lever having a first end which extends to a perimeter of the nip to block a tip of the paper moving toward the nip and a second end which extends to a perimeter of the first sensor, the lever being installed to be rotatable with respect to a predetermined pivot axis between the first end and the second end of the lever. When the first end of the lever is pressed by the tip of the paper and reaches a first position, the first sensor determines that the tip of the paper is entering the nip and generates the first sensing signal. When the first end of the lever is pressed by the tip of the paper and reaches a second position at which the paper has proceeded farther than at the first position, the first sensor determines that the tip of the paper has passed through the nip and generates the second sensing signal.

The paper arranging device may further include a clutch to selectively transfer power generated by a driving source to the driving roller, and the controller may control time when the driving roller is rotated by operating the clutch based on the first sensing signal output from the first sensor.

The controller may control when the photosensitive medium is exposed to the light by operating the light scanning device and the photosensitive medium based on the second sensing signal output from the first sensor.

The paper arranging device may further include a stopper to regulate a rotation angle of the lever.

The lever may be elastically biased, such that the first end of the lever returns to an initial position thereof where the first end of the lever blocks the tip of the paper moving toward the nip.

The first sensor may be a photosensor.

The paper arranging device may further include a second sensor which is spaced apart from the first sensor and senses a location of the moving paper. When the first end of the lever is pressed by the tip of the paper and reaches a third position deviating from the path of the paper, the second sensor may determine that the paper is passing through the nip and may generate a third sensing signal. When the first end of the lever returns to the initial position from the third position, the second sensor may determine that an end of the paper passes through the nip and may generate a fourth sensing signal.

The second sensor may be a photosensor.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
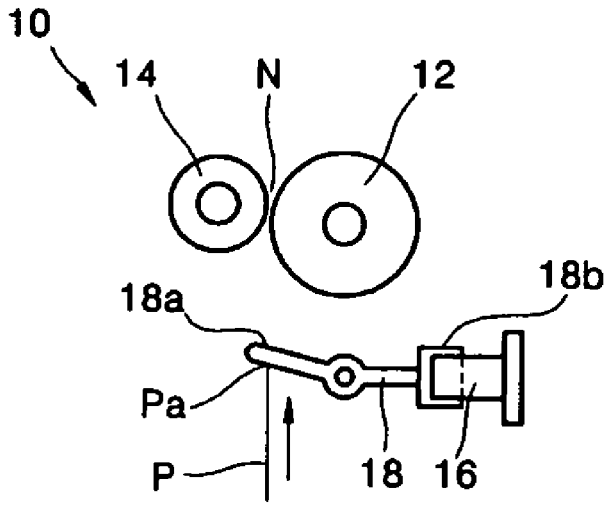
FIG. 1 (PRIOR ART)
FIGS. 1 and 2 are diagrams illustrating the operation of a conventional paper arranging device to be installed in a conventional electrophotographic image forming apparatus.
Figure 2:
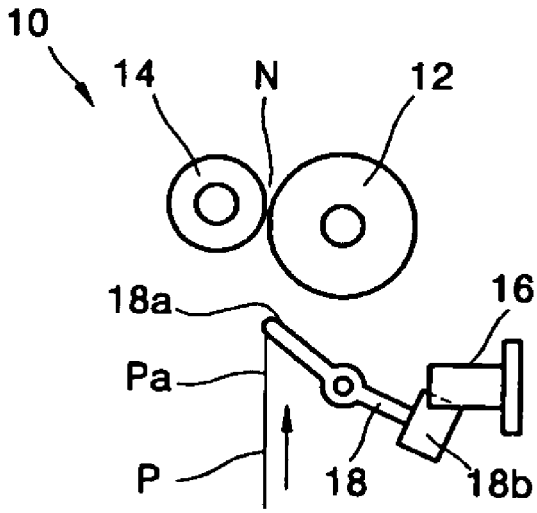
FIG. 2 (PRIOR ART)
Figure 3:
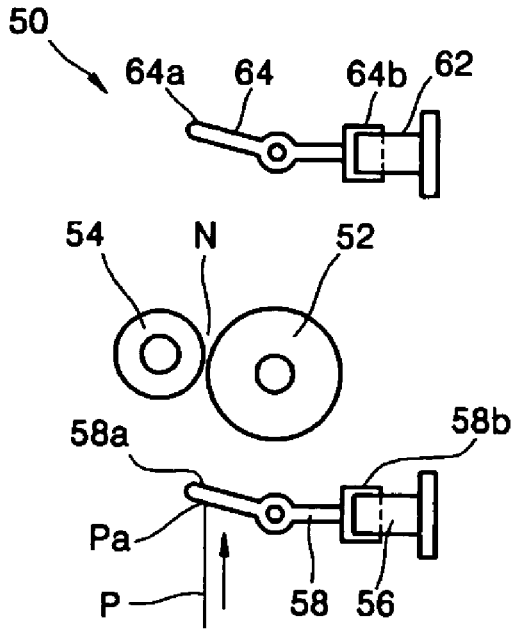
FIG. 3 (PRIOR ART)
FIGS. 3 through 5 are diagrams illustrating the operation of another conventional paper arranging device to be installed in a conventional electrophotographic image forming apparatus.
Figure 4:
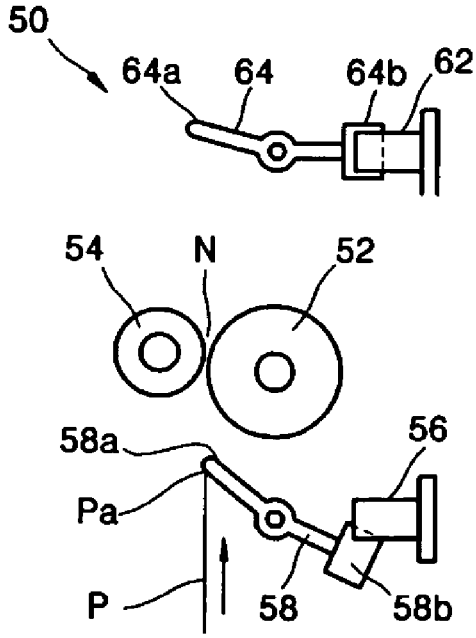
FIG. 4 (PRIOR ART)
Figure 5:
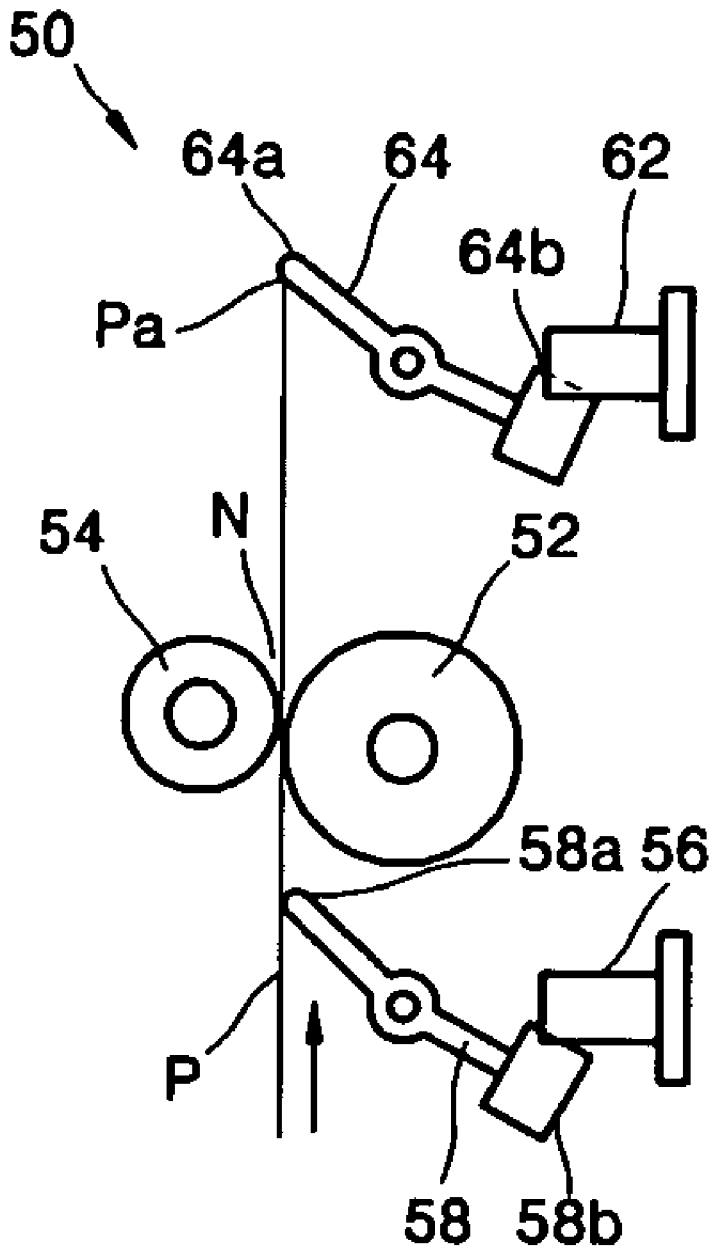
FIG. 5 (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 6:
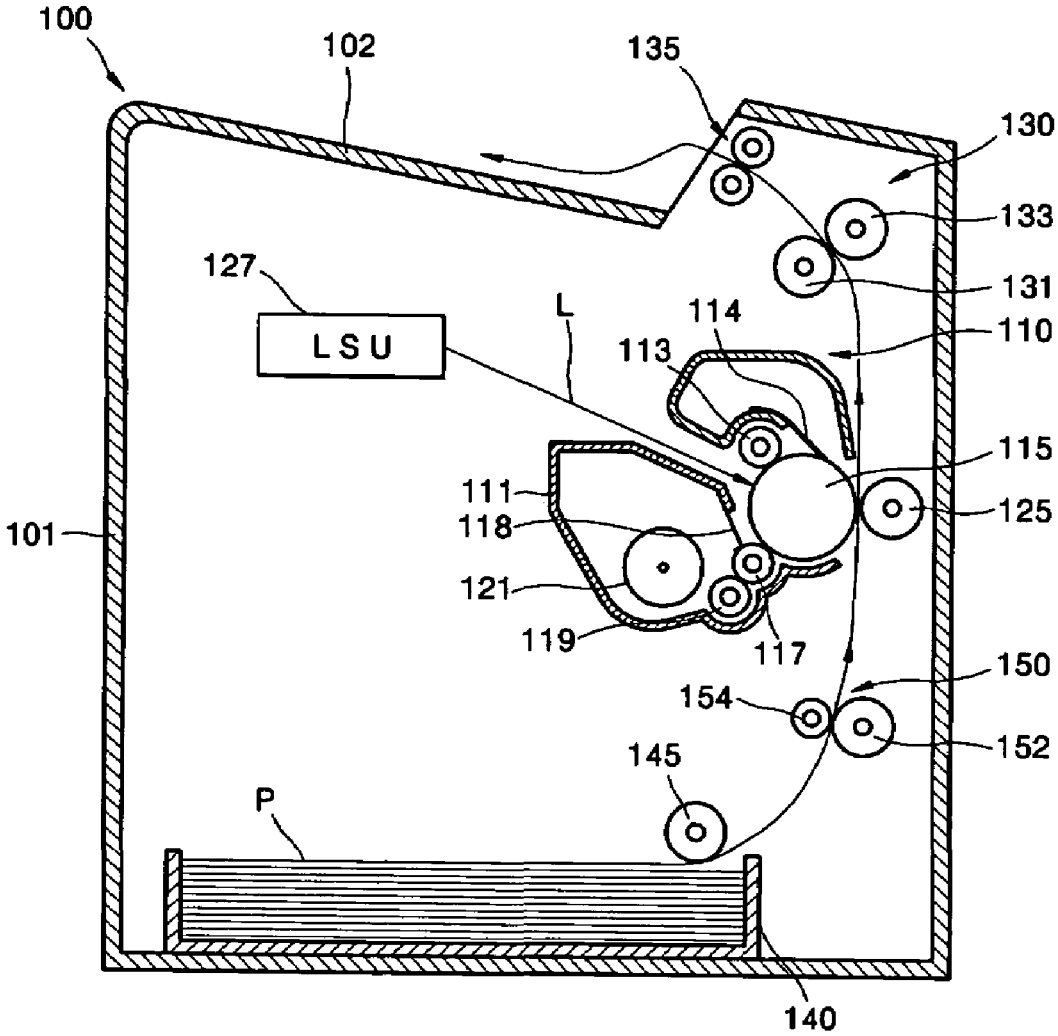
FIG. 6 is a schematic cross-sectional view illustrating an electrophotographic image forming apparatus according to an embodiment of the present general inventive concept.
Figure 7:
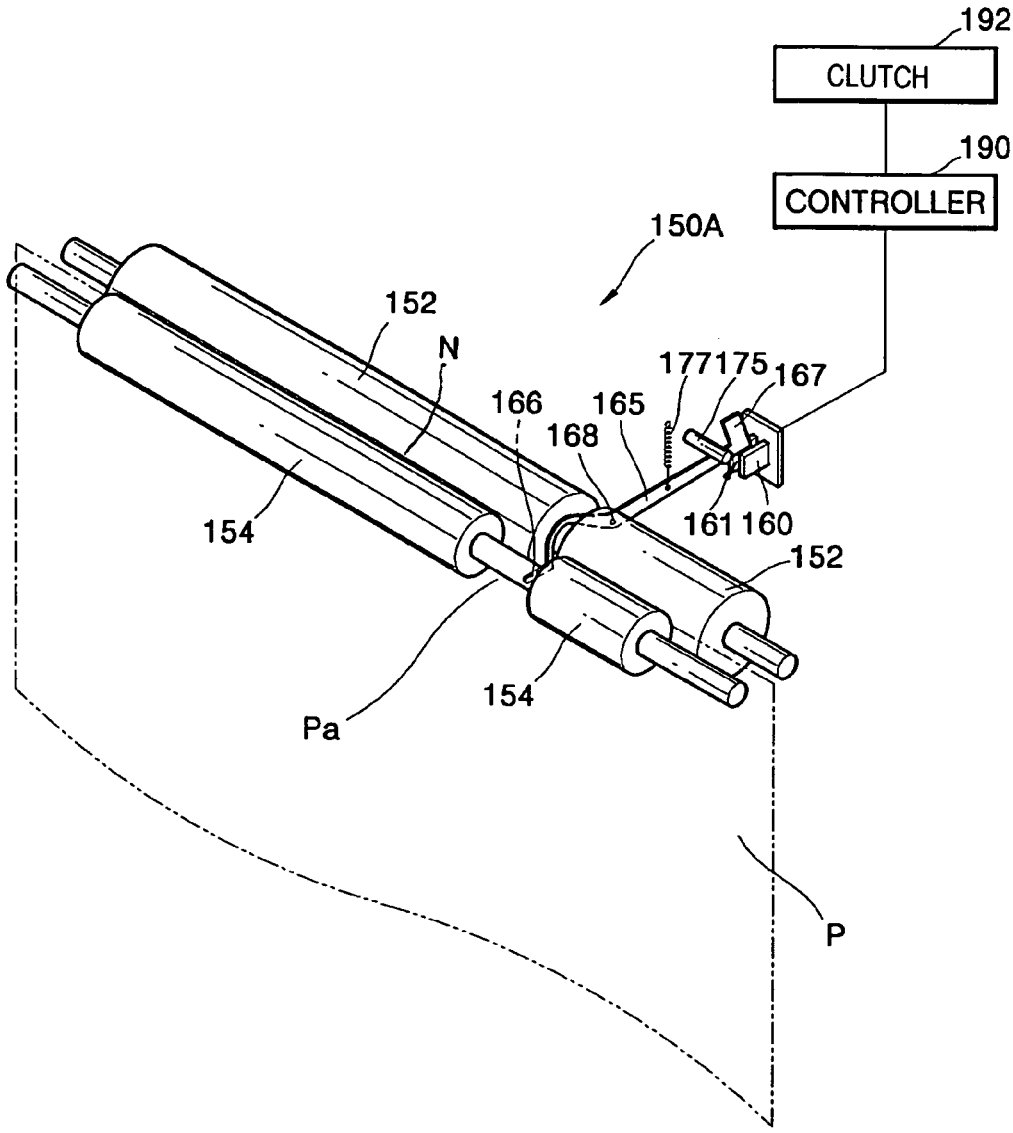
FIG. 7 is a perspective view illustrating a paper arranging device according to an embodiment of the present general inventive concept.

FIG. 6 illustrates an electrophotographic image forming apparatus 100 according to an embodiment of the present general inventive concept. Referring to FIG. 6, the electrophotographic image forming apparatus 100 includes a case 101, a developing unit 110 installed to be easily mounted into and removed from the case 101, a fusing unit 130, a transfer roller 125, and a light scanning unit (LSU) 127. In the electrophotographic image forming apparatus 100, as illustrated in FIG. 6, paper P is delivered along a reverse C-shaped transfer path.

The developing unit 110 includes a housing 111 to store a developing solution, i.e., toner, a photosensitive medium 115 to form a latent image thereon through optical scanning, a charging roller 113 that charges the photosensitive medium 115, a waste developing solution cleaner 114 that removes waste developing solution from the photosensitive medium 115, a developing roller 117 that develops the latent image formed on a circumference of the photosensitive medium 115 into a visual image by supplying the developing solution to the latent image on a circumference of the photosensitive medium 115, a doctor blade 118 that controls a thickness of the developing solution adhering to a surface of the developing roller 117, and a supply roller 119 that supplies the developing solution to the developing roller 117. An agitator 121 is installed in the housing 111 to stir the developing solution so that the developing solution does not harden. The developing unit 110, as illustrated in FIG. 6, is a cartridge type. Thus, when the developing solution stored in the developing unit 110 is consumed, the developing unit 110 can be replaced with a new developing unit.

The transfer roller 125 is installed to face the photosensitive medium 115. The visual image developed on the circumference of the photosensitive medium 115 is transferred onto the paper P passing between the transfer roller 125 and the photosensitive medium 115, using a transfer bias or contact pressure between the transfer roller 125 and the photosensitive medium 115.

The fusing unit 130 includes a heat roller 131 and a pressure roller 133 installed to face the heat roller 131. When the paper P onto which the visual image is transferred passes between the heat roller 131 and the pressure roller 133, the visual image is fused with the paper P through thermocompression that uses heat and pressure.

The electrophotographic image forming apparatus 100 further includes a pickup roller 145, a paper arranging device 150, and an exit roller 135. The pickup roller 145 picks up a sheet of the paper P stacked in a paper feeding cassette 140 installed at a bottom of the case 101. The paper arranging device 150 provides a transfer power to the picked up paper P, and arranges the picked up paper P to be delivered toward the photosensitive medium 115 such that the visual image can be transferred onto a predetermined portion of the paper P. The paper arranging device 150 includes a driving roller 152 and an idle roller 154. The exit roller 135 helps to drive the paper P printed with the image to an output tray 102 at an outer portion of the case 101.

Operations of the electrophotographic image forming apparatus 100 will now be described. The photosensitive medium 115 is charged with a predetermined electric potential through the charging roller 113, and exposed to light L scanned by the light scanning device 127 to form a latent image on the circumference of the photosensitive medium 115, the latent image corresponding to an image to be printed. The toner contained in the housing 111 of the developing unit 110 is supplied to the photosensitive medium 115 on which the latent image is formed, through the supply roller 119 and the developing roller 117. Then, the latent image is developed into the visual image. The paper P stacked in the paper feeding cassette 140 is picked up by the pickup roller 145, fed and arranged by the paper arranging device 150, and passes between the photosensitive medium 115 and the transfer roller 125. Then, the visual image developed on the circumference of the photosensitive medium 115 is transferred onto a side of the paper P facing the photosensitive medium 115. When the transferred visual image passes through the fusing unit 130, the fusing unit 130 applies heat and pressure onto the paper P to fuse the visual image with the paper P. Thereafter, the paper P is transferred to the output tray 102 by the exit roller 135.

FIGS. 7 through 11 illustrate a paper arranging, device 150A according to an embodiment of the present general inventive concept. The paper arranging device 150A includes a driving roller 152 and an idle roller 154 that are installed closely together to face each other, thus forming a nip N therebetween, a photosensor 160 that senses the location of the paper P that is being delivered, and a lever 165 pressed and rotated by a tip Pa of the moving paper P. The driving roller 152 is rotated by power generated by a motor (not shown) installed in the case 101 (see FIG. 6), and connected to the motor via an electronic clutch 192. The power generated by the motor is selectively transferred to the driving roller 152 through the electronic clutch 192. The electronic clutch 192 is electrically connected to a controller 190, and operates in response to a control signal generated by the controller 190. The motor, the electronic clutch 192, and the controller 190 are obvious to those ordinarily skilled in the art, and detailed descriptions thereof will be omitted. The driving roller 152 may have a cutout portion, and the lever 165 may be disposed in the cutout portion.

A first end 166 of the lever 165 extends to the nip N at an initial position such that the first end 165 contacts the tip Pa of the paper P as the tip Pa of the paper P approaches the nip N by the pickup roller 145 (see FIG. 6) in a forward movement direction, and a second end 167 of the lever 165 extends to the photosensor 160 such that the second end 167 is positioned above a slit 161 of the photosensor 160 at the initial position. The lever 165 is installed to be rotatable with respect to a predetermined pivot 168 between the first and second ends 166 and 167. The lever 165 is elastically biased by a spring 177 in a counterclockwise direction to return the lever 165 to the initial position even when the tip Pa of the moving paper P presses the lever 165 to rotate the lever 165 in a clockwise direction with respect to the pivot 168. An end of the spring 177 is connected to a predetermined frame (not shown) in the case 101 (see FIG. 6), and another end thereof is connected to the lever 165. A stopper 175 is further installed in the case 101 to control a rotation angle of the lever 165 rotated in the counterclockwise direction by the spring 177 after the paper P passes through the nip N. When the lever 165 is rotated in the counterclockwise direction by the spring 177, the stopper 175 stops the rotation of the lever 165 at the initial position. As illustrated in FIGS. 8-11, the lever 165 is rotated in the clockwise direction by the paper P and in the counterclockwise direction by the spring 177, but the present general inventive concept is not limited thereto. The lever 165 may alternatively be rotated in the counterclockwise direction by the paper P and the clockwise direction by the spring 177.

The slit 161 is formed in the photosensor 160 lengthwise such that the second end 167 of the lever 165 can pass through the photosensor 160. A light emitting unit (not shown) that emits a laser light, and a light receiving unit (not shown) that receives the laser light are mounted on opposite inner walls of the slit 161. The construction of the slit 161 is obvious to those ordinarily skilled in the art, and thus, a detailed description thereof will not be described. The photosensor 160 is electrically connected to the controller 190, senses a position of the paper P, generates first and second sensing signals indicating the position of the paper P, and transmits the first and second sensing signals to the controller 190.

Figure 8:
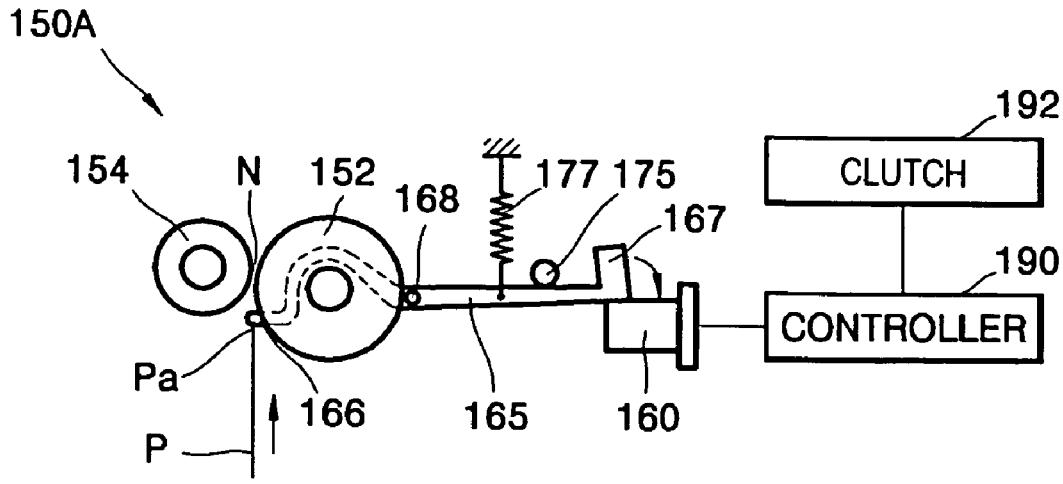
FIGS. 8 through 11 are diagrams illustrating operations of the paper arranging device of FIG. 7.

Operations of the paper arranging device 150A of FIGS. 7-11 will now be described. Referring to FIG. 8, when the lever 165 is at the initial position, the first and second ends 166 and 167 of the lever 165 are positioned directly under the nip N and above the photosensor 160, respectively. Until the paper P picked up by the pickup roller 145 (see FIG. 6) moves upward and the tip Pa of the paper P reaches the first end 166 of the lever 165, the electronic clutch 192 disconnects the driving roller 152 from the motor in response to a control signal generated by the controller 190. In this case, the driving roller 152 and the idle roller 154 installed adjacent to the driving roller 152 do not rotate.

Figure 9:
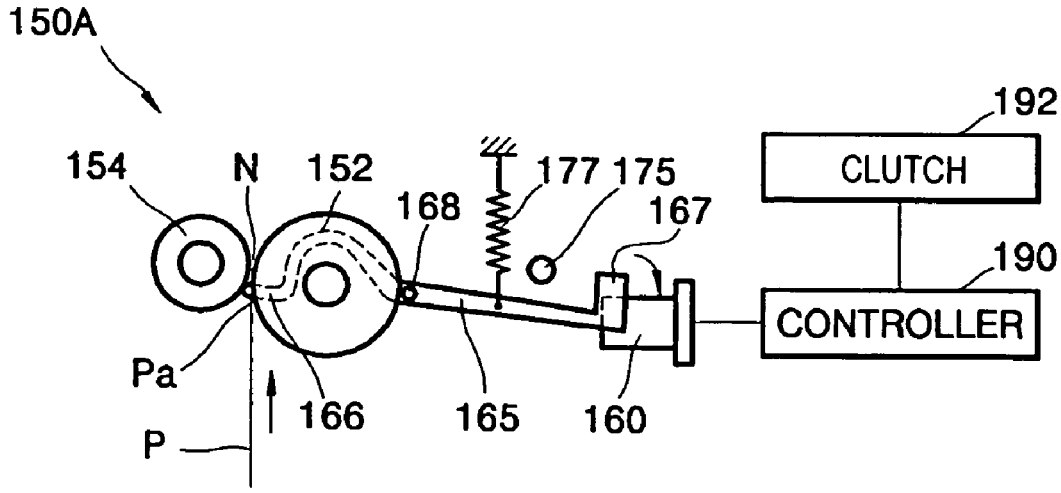

Referring to FIG. 9, when the tip Pa of the paper P presses the first end 166 of the lever 165 upward to a first position, the lever 165 is rotated in the clockwise direction to turn the second end 167 of the lever 165 downward. Thus, the second end 167 of the lever 165 enters the slit 161 of the photosensor 160, and the laser light emitted by the light emitting unit of the photosensor 160 is blocked by the second end 167 of the lever 165, thereby preventing light from being input to the light receiving unit. In this case, the photosensor 160 determines that the tip Pa of the paper P is approaching the nip N, and generates the first sensing signal.

Then, the tip Pa of the paper P is stopped and curled by the nip N to arrange the paper P. The first sensing signal output from the photosensor 160 is transmitted to the controller 190. The controller 190 generates a control signal a first interval after the controller 190 receives the first sensing signal, and transmits the control signal to the electronic clutch 192 to operate the electronic clutch 192. When the electronic clutch 192 operates, the driving roller 152 is connected to the motor, and as a result, the driving roller 152 and the idle roller 154 installed adjacent to the driving roller 152 rotate to move the paper P.

Figure 10:
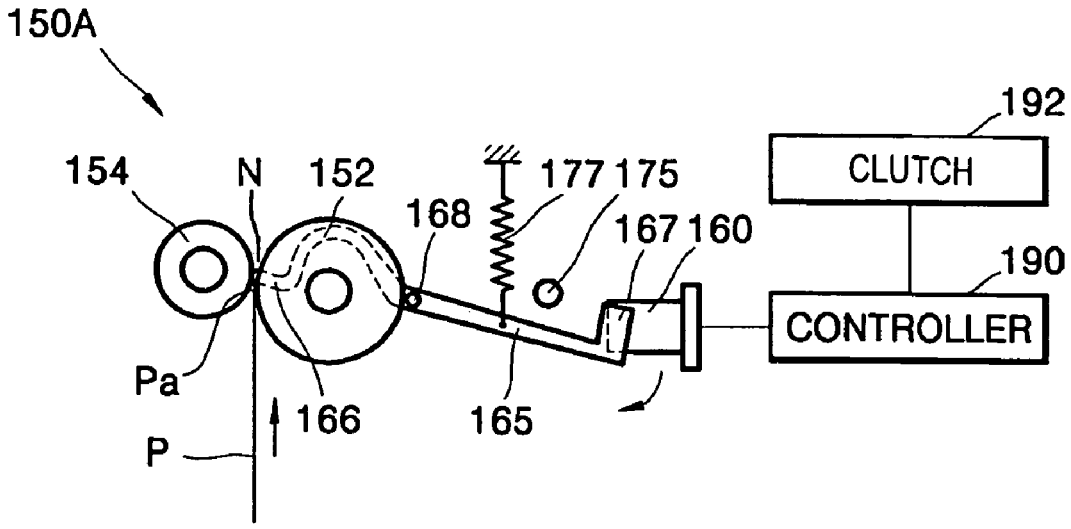
Figure 11:
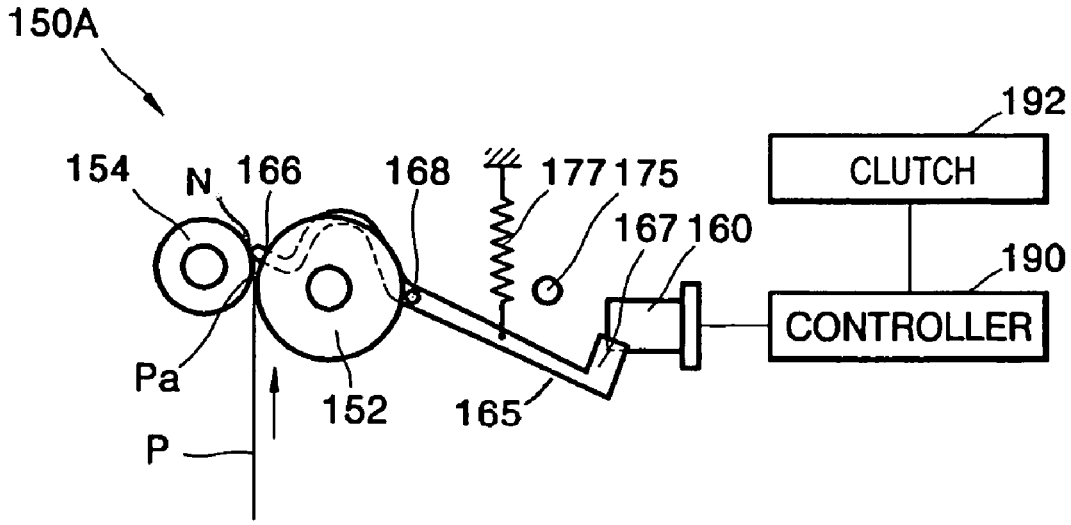
Figure 12:
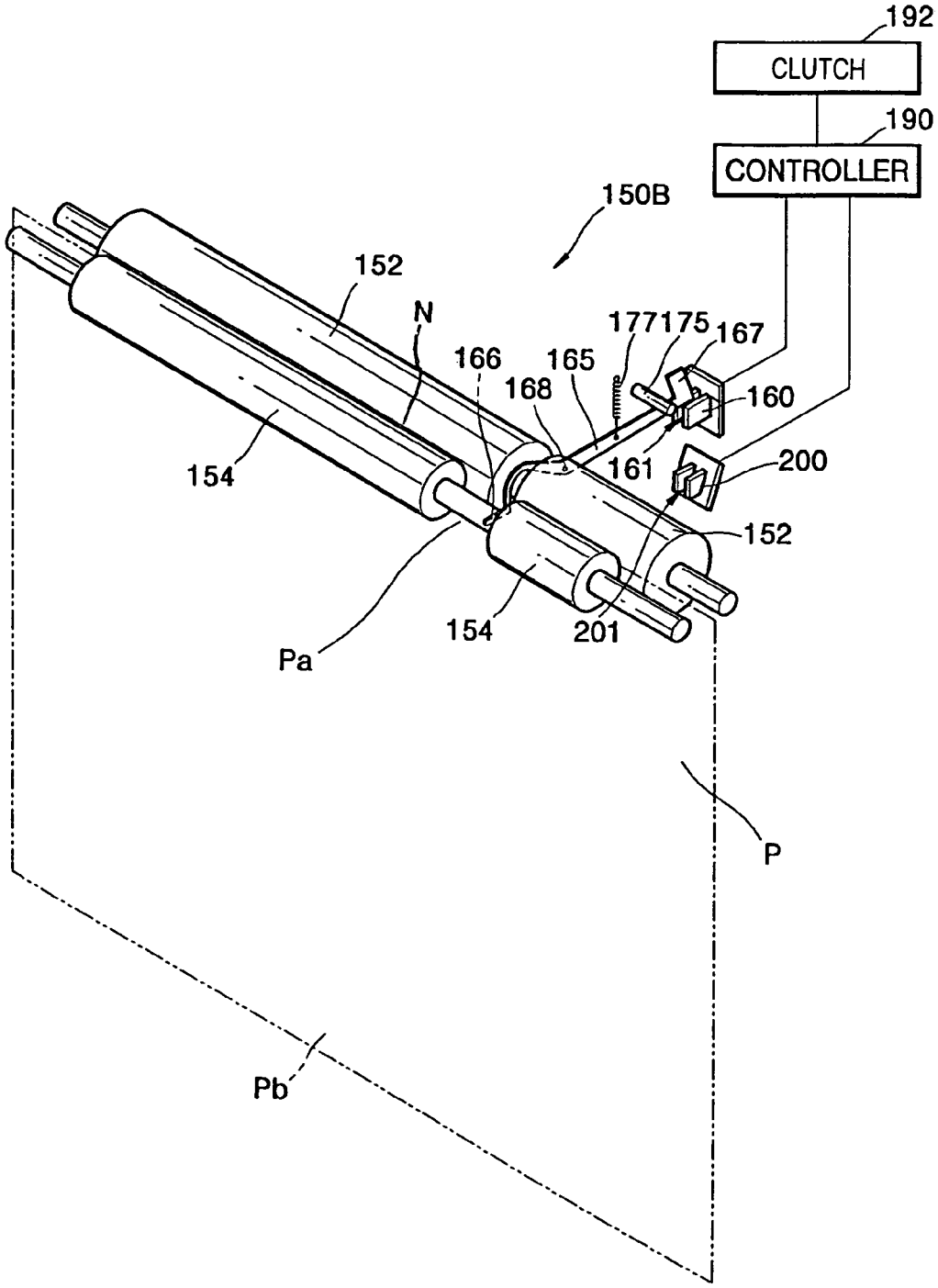
FIG. 12 is a perspective view illustrating a paper arranging device according to another embodiment of the present general inventive concept.

Referring to FIG. 10, the first end 166 of the lever 165 is continuously rotated in the clockwise direction while being pressed by the tip Pa of the paper P passing through the nip N. Referring to FIG. 11, when the first end 166 reaches a second position at which the paper P has proceeded farther than at the first position, the second end 167 of the lever 165 does not intercept the light emitted by the light emitting unit of the photosensor 160. Thus, the laser light is received by the light receiving unit, and the photosensor 160 determines that the tip Pa of the paper P has passed through the nip N, and generates the second sensing signal.

The second sensing signal output from the photosensor 160 is transmitted to the controller 190. The controller 190 generates and transmits a control signal a second interval after receiving the second sensing signal, so that the light scanning device 127 and the photosensitive medium 115 (see FIG. 6) operate to expose the photosensitive medium 115 to light L. The second interval is computed from the moving speed of the tip Pa of the paper P passing through the nip N and the distance between the nip N and the photosensitive medium 115. The operations of the light scanning device 127 and the photosensitive medium 115 are not substantially affected by an irregular delay in the operation of the electronic clutch 192, thereby minimizing an error between a substantial position and desired position of the image printed on the paper P.

If the paper arranging device 150A is installed in an electrophotographic image forming apparatus, an error between a desired position and a substantial position of an image to be formed on paper is minimized, thereby improving the quality of printing. Further, the paper arranging device 150A requires one sensor and one lever, thereby reducing manufacturing costs.

FIGS. 12 through 17 illustrate a paper arranging device 150B according to another embodiment of the present general inventive concept. Compared to the paper arranging device 150A of FIGS. 7 through 11, the paper arranging device 150B of FIGS. 12 through 17 further includes a second photosensor 200 installed to be spaced apart from a first photosensor 160. The first and second photosensors 160 and 200 are upper and lower photosensors positioned along a circumference of a circle with a center at the pivot axis 168 of the lever 165. Similar to the first photosensor 160, the second photosensor 200 is electrically connected to the controller 190, and generates third and fourth sensing signals and transmits the third and fourth sensing signals to the controller 190 when the second photosensor 200 senses the location of the paper P.

Figure 13:
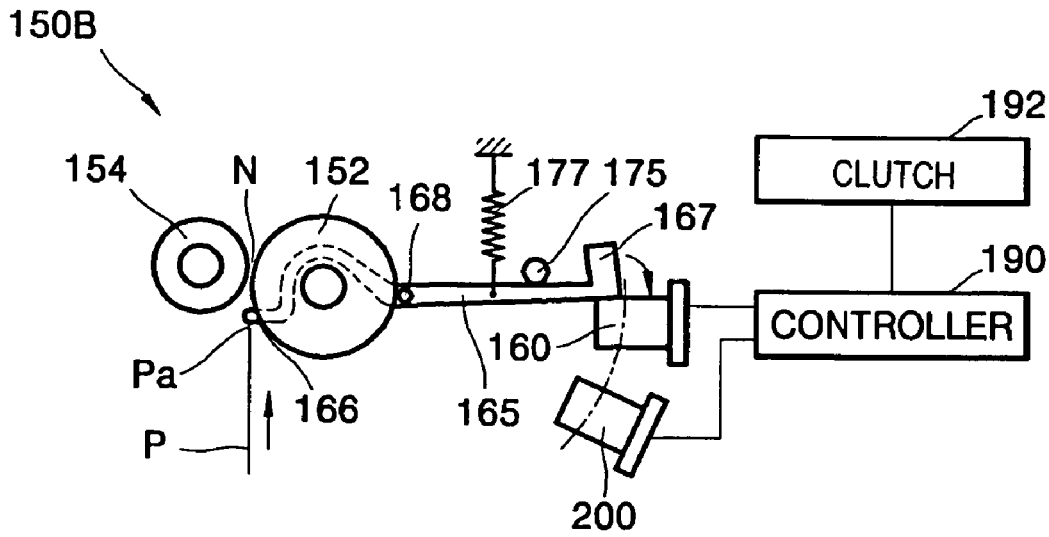
FIGS. 13 through 17 are diagrams illustrating operations of the paper arranging device of FIG. 12.

The operation of the paper arranging device 150B of FIGS. 12-17 will now be described in detail. Referring to FIG. 13, when the lever 165 is present at the initial position, the first end 166 of the lever 165 is positioned directly under the nip N and the second end 167 of the lever 165 is positioned above the first photosensor 160. Until the paper P is delivered upward and a tip Pa of the paper P contacts the first end 166 of the lever 165, the electronic clutch 192 disconnects the driving roller 152 from a motor (not shown) according to a control signal output from the controller 190, thereby preventing the driving roller 152 and the idle roller 154 from rotating.

Figure 14:
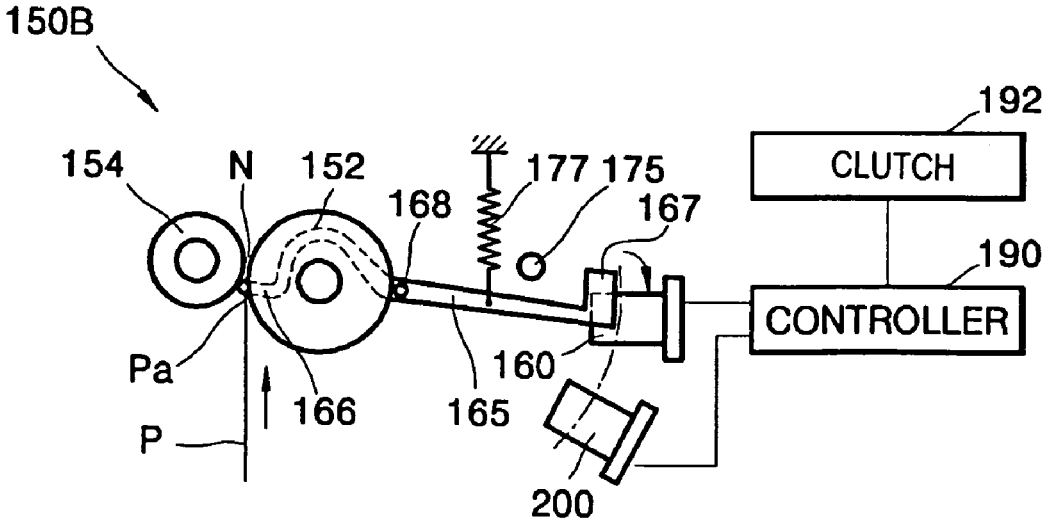

Referring to FIG. 14, when the tip Pa of the paper P presses the first end 166 of the lever 65 upward to the first position, the lever 165 is rotated in the clockwise direction to turn the second end 167 of the lever 165 downward. Thus, the second end 167 enters a first slit 161 (see FIG. 12) of the first photo sensor 160, and the laser light emitted by the light emitting unit (not shown) of the first photosensor 160 is blocked by the second end 167. In this case, the first photosensor 160 determines that the tip Pa of the paper P is approaching the nip N, and generates the first sensing signal.

Then, the tip Pa of the paper P is stopped and curled by the nip N to arrange the paper P. The first sensing signal output from the first photosensor 160 is transmitted to the controller 190. The controller 190 generates a control signal and transmits the generated control signal to the electronic clutch 192 at the first time interval after the controller 190 receives the first sensing signal, thereby operating the electronic clutch 192. When the electronic clutch 192 operates, the driving roller 152 is connected to the motor, and the driving roller 152 and the idle roller 154 installed adjacent to the driving roller 152 rotate, thus moving the paper P.

Figure 15:
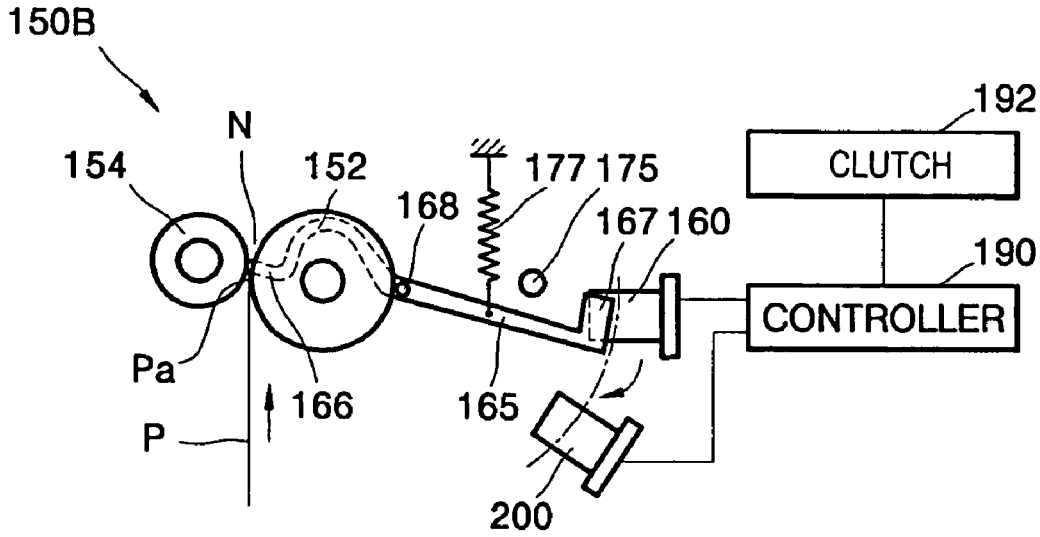
Figure 16:
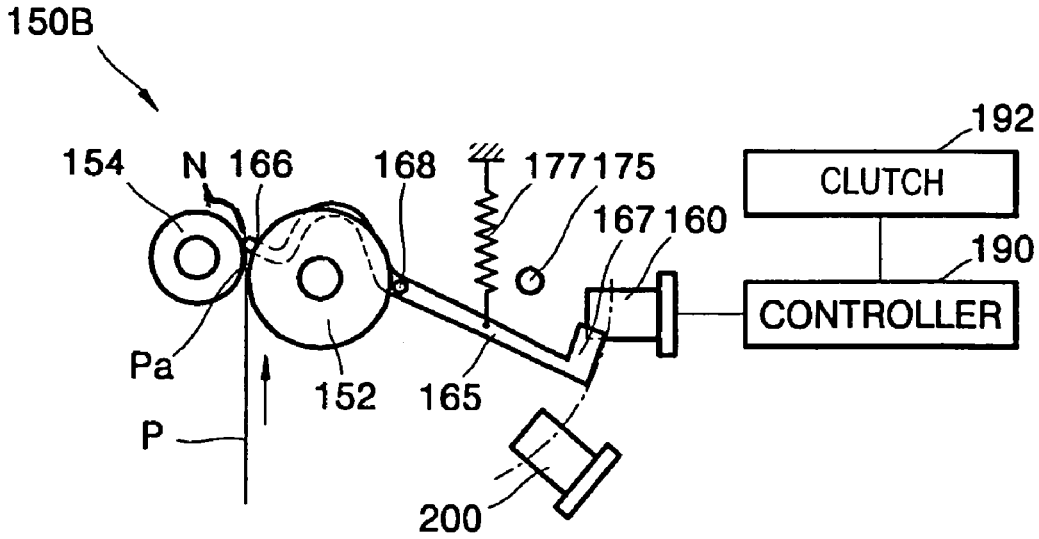

Referring to FIG. 15, the lever 165 is continuously rotated while the first end 166 of the lever 165 is pressed by the tip Pa of the paper P, which passes through the nip N. As illustrated in FIG. 16, when the first end 166 reaches the second position at which the paper P has proceeded farther than at the first position, the second end 167 does not intercept the laser light emitted by the light emitting unit of the first photo sensor 160. Thus, the light is received by the light receiving unit of the first photosensor 160, and the first photosensor 160 determines that the tip Pa of the paper P has passed through the nip N, and generates the second sensing signal.

The second sensing signal output from the first sensor 160 is transmitted to the controller 190. The controller 190 generates and transmits a control signal at the second interval after it receives the second sensing signal, such that the light scanning unit 127 and the photosensitive medium 115 (see FIG. 6) operate to expose the photosensitive medium 115 to the light L. The second interval is computed from the moving speed of the nip N of the paper P passing through the nip N and the distance between the tip Pa and the photosensitive medium 115. Therefore, the operations of the light scanning unit 127 and the photosensitive medium 115 are not substantially affected by an irregular delay in the operation of the electronic clutch 192, thereby minimizing an error between a substantial position and desired position of an image to be formed on the paper P.

Figure 17:
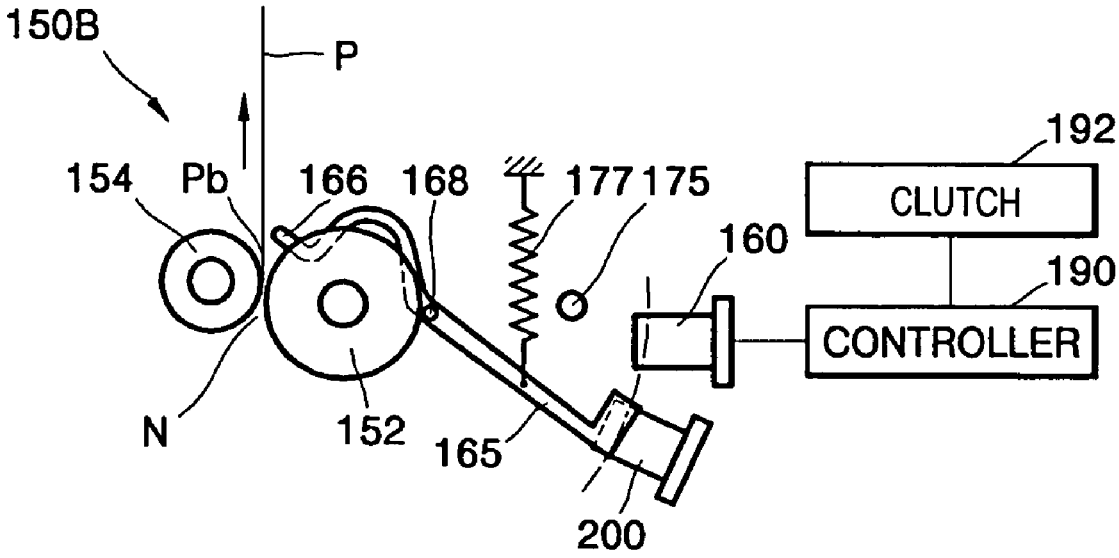

When the paper P is moving upward, the first end 166 of the lever 165 reaches a third position which deviates from a path of the paper P. Referring to FIG. 17, the second end 167 of the lever 165 enters a second slit 201 (see FIG. 12) of the second photosensor 200 at the third position. In this case, laser light emitted by a light emitting unit (not shown) of the second photosensor 200 is blocked by the second end 167 and is not received by a light receiving unit (not shown) of the second photosensor 200. Therefore, the second photosensor 200 determines that the paper P is passing through the nip N, and generates the third sensing signal.

When an end Pb of the paper P passes through the nip N, the lever 165 is rotated in the counterclockwise direction by the spring 177 until the lever 165 bumps against a stopper 175 and is stopped. When the lever 165 is stopped, the lever 165 returns to the initial position, as illustrated in FIG. 13. In this case, the second end 167 of the lever 165 does not intercept the light emitted by the light emitting unit of the second photosensor 200, and the light is input to the light receiving unit of the second photosensor 200. Then, the second photosensor 200 determines that the end Pb of the paper P has passed through the nip N and generates the fourth sensing signal.

The third and fourth sensing signals are sequentially generated by the second photosensor 200 and transmitted to the controller 190. The controller 190 may compute the length of the paper P from the moving speed of the paper P and an interval between the third and fourth sensing signals. When the controller 190 does not receive the fourth sensing signal within a predetermined length of time after it receives the third sensing signal, the controller 190 may determine that a paper jam has occurred during the movement of the paper P, and transmit a message to a display panel (not shown) of the electrophotographic image forming apparatus 100 (see FIG. 6) to inform a user of the paper jam.

If the paper arranging device 150B is installed in an image forming apparatus, an error between a substantial position and desired position of an image to be formed on paper is minimized, thereby improving the quality of printing.

The paper arranging device 150B as described above may measure the length of supplied paper and senses the paper jam, and thus, an image forming apparatus does not require additional elements to perform these operations, thereby reducing manufacture costs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper arranging device usable with an electrophotographic image forming apparatus, comprising:

a driving roller and an idle roller disposed adjacent to each other to form a nip on a paper path;

a first sensor to emit a laser light to sense a location of moving paper along the paper path;

a lever having a first end which extends to a perimeter of the nip of the paper path to block a tip of the paper moving along the paper path toward the nip of the paper path and a second end which extends to a perimeter of the sensor, the lever being rotatable with respect to a predetermined pivot axis between the first end and the second end of the lever, wherein when the first end of the lever is pressed by the tip of the moving paper and reaches a first position, thereby covering the first sensor with the second end of the lever such that the laser light is blocked, the first sensor determines that the tip of the paper is entering the nip of the paper path and generates a first sensing signal, and when the first end of the lever is pressed by the tip of the moving paper and reaches a second position further along the paper path than the first position, thereby exposing the first sensor such that the laser light is unblocked, the first sensor determines that the tip of the paper has passed through the nip of the paper path and generates a second sensing signal, wherein at least one of the driving roller and the idle roller comprises a cutout portion, and the lever is disposed in the cutout portion, and the second end has a length to maintain the blocking of the laser light so as to correspond to a movement of the first end between the first position and the second position, and a second sensor which is spaced apart from the first sensor to sense the location of the moving paper, wherein when the first end of the lever is pressed by the tip of the paper and reaches a third position deviating from the paper path, the second sensor determines that the paper is passing through the nip and generates a third sensing signal, and when the first end of the lever returns to an initial position from the third position, the second sensor determines that an end of the paper has passed through the nip and generates a fourth sensing signal.

2. The paper arranging device of claim 1, wherein a time when the driving roller is rotated is determined based on the first sensing signal output from the first sensor.

3. The paper arranging device of claim 1, wherein a time when a photosensitive medium of the electrophotographic image forming apparatus on which a latent image is formed is exposed to light, is determined based on the second sensing signal output from the first sensor.

4. The paper arranging device of claim 1, further comprising a stopper to regulate a rotation angle of the lever.

5. The paper arranging device of claim 1, wherein the lever is elastically biased, such that the first end of the lever can return to an initial position thereof where the first end of the lever blocks the tip of the paper moving toward the nip.

6. The paper arranging device of claim 1, wherein the first sensor comprises a photosensor.

7. The paper arranging device of claim 1, wherein the first and second sensors comprise photo sensors.

8. The paper arranging device of claim 1, wherein the first and second sensors are positioned along a circumference of a circle having a center at the pivot axis of the lever.

9. The paper arranging device of claim 1, wherein the first position and the second position are disposed opposite to each other with respect to the nip.

10. The paper arranging device of claim 1, wherein the first position, the nip, and the second position are disposed along the paper path in order.

11. An electrophotographic image forming apparatus comprising:

a light scanning device to irradiate light corresponding to an image signal;

a photosensitive medium on which a latent image is formed when the photosensitive medium is exposed to the light irradiated from the light scanning device;

a paper arranging device, comprising:

a driving roller and an idle roller which are positioned before the photosensitive medium along a path of paper, the driving roller and the idle roller disposed adjacent to each other to form a nip on the paper path, a first sensor to emit a laser light to sense a location of the moving paper, and a lever having a first end which extends to a perimeter of the nip of the of the paper path to block a tip of the paper moving toward the nip of the paper path and a second end which extends to a perimeter of the first sensor, the lever being installed to be rotatable with respect to a predetermined pivot axis between the first end and the second end of the lever, wherein when the first end of the lever is pressed by the tip of the paper and reaches a first position, thereby covering the first sensor with the second end of the lever such that the laser light is blocked, the first sensor determines that the tip of the paper is entering the nip of the paper path and generates a first sensing signal, and when the first end of the lever is pressed by the tip of the paper and reaches a second position farther along the path of the paper from the first position, thereby exposing the first sensor such that the laser light is unblocked, the first sensor determines that the tip of the paper has passed through the nip of the paper path and generates a second sensing signal; and a controller to control times when the driving roller rotates and when the photosensitive medium is exposed to the light based on the first sensing signal and the second sensing signal output from the first sensor, wherein the paper arranging device further comprises a second sensor which is spaced apart from the first sensor to sense a location of the moving paper, when the first end of the lever is pressed by the tip of the paper and reaches a third position deviated from the path of the paper, the second sensor determines that the paper is passing through the nip and generates a third sensing signal, and when the first end of the lever returns to the initial position thereof from the third position, the second sensor determines that an end of the paper has passed through the nip and generates a fourth sensing signal.

12. The electrophotographic image forming apparatus of claim 11, wherein the paper arranging device further comprises a clutch to selectively transfer power generated by a driving source to the driving roller, and the controller controls the time when the driving roller rotates by operating the clutch based on the first sensing signal output from the first sensor.

13. The electrophotographic image forming apparatus of claim 11, wherein the controller controls when the photosensitive medium is exposed to the light by operating the light scanning device and the photosensitive medium based on the second sensing signal output from the first sensor.

14. The electrophotographic image forming apparatus of claim 11, wherein the paper arranging device further comprises:

a stopper to regulate a rotation angle of the lever.

15. The electrophotographic image forming apparatus of claim 11, wherein the lever is elastically biased, such that the first end of the lever returns to an initial position thereof where the first end of the lever blocks the tip of the paper moving toward the nip.

16. The electrophotographic image forming apparatus of claim 11, wherein the first sensor comprises a photosensor.

17. The electrophotographic image forming apparatus of claim 11, wherein the first and second sensors comprise photo sensors.

18. A paper arranging apparatus usable with an image forming apparatus, comprising:

a driving roller and an idle roller to transfer paper along a nip disposed on a paper path;

a lever having a first end disposed around the nip of the paper path and to move between a first position when the paper is at a first location along the paper path to enter the nip and a second position when the paper is at a second location being further along the paper path than the first location to exit the nip, the first and second positions being disposed opposite to each other with respect to the nip disposed on the paper path by a force of the paper; and a first sensor to emit a laser light to sense the first and second positions of the lever, such that the first position of the lever covers the first sensor with the second end of the lever, such that the laser light is blocked and the second position of the lever exposes the first sensor such that the laser light is unblocked, and to generate a plurality of sensing signals corresponding to the sensed first and second positions, wherein at least one of the driving roller and the idle roller comprises a cutout portion formed along the paper path, the first end of the lever is disposed in the cutout portion to move to the first position and the second position by the force of the paper, and the second end of the lever is extended from the first end toward the first sensor to be rotatable with respect to a pivot between the first end and the second end, and a second sensor disposed apart from the first sensor along a moving path of the lever to sense additional positions of the lever and to generate a plurality additional sensing signals corresponding to the additional sensed positions.

19. The paper arranging apparatus of claim 18, further comprising:

a controller to receive the plurality of sensing signals and control the driving roller and the image forming apparatus according to the received plurality of sensing signals.

20. The paper arranging apparatus of claim 19, wherein the controller controls the driving roller to rotate according to one of the plurality of sensing signals.

21. The paper arranging apparatus of claim 18, wherein the driving roller and the idle roller operate to transfer the paper according to one of plurality of sensing signals.

22. The paper arranging apparatus of claim 18, wherein the plurality of sensing signals comprise a first sensing signal generated when the lever is in the first position by a tip of the paper reaching the nip, and a second sensing signal generated when the lever is in the second position by the tip of the paper exiting the nip.

23. The paper arranging apparatus of claim 22, wherein the driving roller rotates according to the first sensing signal.

24. The paper arranging apparatus of claim 18, wherein a length of the paper is measured according to the plurality of additional sensing signals.

25. The paper arranging apparatus of claim 18, wherein a paper jam is detected according to the plurality of additional sensing signals.

26. The paper arranging apparatus of claim 18, wherein the additional sensed positions comprise a third position and a fourth position, and the plurality of additional sensing signals comprise a first additional sensing signal generating when the lever is in the third position by the paper passing through the driving roller and the idle roller, and a second additional sensing signal generating when the lever is in the fourth position by an end portion of the paper exiting the driving roller and the idle roller.

27. The paper arranging apparatus of claim 18, further including:

a spring to elastically bias the lever opposite to the force of the paper to return the lever to an initial position thereof when the paper exits the driving roller and the idle roller; and a stopper to stop the lever at the initial position thereof when the spring returns the lever to the initial position.

28. The paper arranging apparatus of claim 18, wherein the lever comprises:

a first end disposed directly before the driving roller and the idle roller in the paper path, such that the paper contacts the first end to move the lever; and a second end to activate the first sensor when the lever moves.

29. The paper arranging apparatus of claim 18, wherein the lever comprises an end to contact the paper, and the end of the lever is disposed within a distance less than a radius of at least one of the driving roller and the idle roller from the nip.

30. The paper arranging apparatus of claim 18, wherein the lever moves to the positions and through the nip along the paper path.

31. An electrophotographic image forming apparatus, comprising:

a developing unit to develop a latent image into a visual image and to transfer the visual image to paper; and a paper arranging unit disposed ahead of the developing unit on a paper path to arrange the paper and transfer the paper to the developing unit, the paper arranging unit comprising:

a transfer unit to transfer the paper to the developing unit along a nip disposed in the paper path, a lever having a first end disposed around the nip of the paper path and to move between a first position when the paper enters the nip and a second position when the paper moves further than the first position to exit the nip, the first and second positions being disposed opposite to each other with respect to the nip disposed in the paper path by a force of the paper, a first sensor to emit a laser light to detect the first and second positions, such that the first position of the lever covers the first sensor with the second end of the lever such that the laser light is blocked and the second position of the lever exposes the first sensor such that the laser light is unblocked, and to generate first and second sensing signals corresponding to the first and second positions of the lever, and a second sensor to generate third and fourth sensing signals corresponding to third and fourth positions of the lever, wherein the transfer unit comprises a cutout portion, the second end of the lever is disposed in the cutout portion to move to the first position and the second position by the force of the paper, and the second end of the lever is extended from the first end toward the first sensor to be rotatable with respect to a pivot between the first end and the second end, and a controller to control the transfer unit and the developing unit according to the first and second sensing signals, respectively.

32. The electrophotographic image forming apparatus of claim 31, wherein the first sensor comprises a slit and the lever comprises:

a first end disposed immediately ahead of the transfer unit in the paper path, such that the paper contacts the first end to move the lever; and a second end to enter the slit when the lever is at the first portion and to exit the slit when the lever is at the second position.

33. The electrophotographic image forming apparatus of claim 31, wherein the controller measures a length of the paper according to the third and fourth sensing signals.

34. The electrophotographic image forming apparatus of claim 31, wherein the controller detects a paper jam according to the third and fourth sensing signals.

35. The electrophotographic image forming apparatus of claim 31, wherein the first position, the nip, and the second position are disposed in order along the paper path.

36. The electrophotographic image forming apparatus of claim 31, wherein the lever comprises an end to contact the paper, and the end of the lever is disposed within a predetermine distance from the nip.

* * * * *